US009221520B2

(12) United States Patent
Roy et al.

(10) Patent No.: US 9,221,520 B2
(45) Date of Patent: Dec. 29, 2015

(54) MODULE FOR MAKING AMBIDROMIC CROSSOVER EQUIPMENT (FAM)

(71) Applicant: CEFA, Soultz Sous Forets (FR)

(72) Inventors: Roger Roy, Montreuil Juigne (FR); Frederic Schmidt, Haguenau (FR)

(73) Assignee: CEFA (FR)

( * ) Notice: Subject to any disclaimer, the term of this patent is extended or adjusted under 35 U.S.C. 154(b) by 0 days.

(21) Appl. No.: 14/394,146

(22) PCT Filed: Feb. 28, 2013

(86) PCT No.: PCT/EP2013/054066
§ 371 (c)(1),
(2) Date: Oct. 13, 2014

(87) PCT Pub. No.: WO2013/152890
PCT Pub. Date: Oct. 17, 2013

(65) Prior Publication Data

US 2015/0059104 A1 Mar. 5, 2015

(30) Foreign Application Priority Data

Apr. 13, 2012 (EP) ..... 12290129

(51) Int. Cl.

| | |
|---|---|
| ***E01D 15/20*** | (2006.01) |
| ***B63B 35/54*** | (2006.01) |
| ***B63B 35/28*** | (2006.01) |
| ***B63B 3/02*** | (2006.01) |

(52) U.S. Cl.
CPC . *B63B 3/02* (2013.01); *B63B 35/54* (2013.01); *E01D 15/20* (2013.01); *B63B 35/28* (2013.01)

(58) Field of Classification Search
CPC ..... E01D 15/22; E01D 15/14; E01D 15/20; E01D 15/12; E01D 15/122; E01D 21/08; B60F 3/0061; B60F 3/00; B60F 3/0092; B63B 35/38; B63B 35/36; B63B 35/34; B63B 35/28; B63B 35/54
USPC ..... 14/2.6
See application file for complete search history.

(56) References Cited

U.S. PATENT DOCUMENTS

| | | | | | |
|---|---|---|---|---|---|
| 3,154,044 | A | * | 10/1964 | Bellas | 114/344 |
| 3,208,087 | A | * | 9/1965 | Edwards | 14/2.6 |
| 3,643,618 | A | * | 2/1972 | Gehlen | 14/2.6 |
| 4,621,385 | A | * | 11/1986 | Gillois | 14/2.4 |

(Continued)

FOREIGN PATENT DOCUMENTS

| | | | | | |
|---|---|---|---|---|---|
| JP | 01210509 | A | * | 8/1989 | E01D 15/12 |
| WO | 0232752 | A1 | | 4/2002 | |

OTHER PUBLICATIONS

International Search Report issued May 2, 2013 re: Application No. PCT/EP2013/054066; citing: WO 02/32752 A1, US 7 267 074 B1 and US 5 353 733 A.

*Primary Examiner* — Abigail A Risic
(74) *Attorney, Agent, or Firm* — Cantor Colburn LLP

(57) ABSTRACT

A module for making a modular ferry and/or a floating bridge including a floatation tank, where the floatation tank is made in the form of two floatation half-tanks hinged together around a hinged line between an opening position in which the two half-tanks are substantially aligned and form the floatation tank, and a closing position in which a half-tank is folded back upon the other half-tank such as a lid thus forming a container box able to enclose all or part of the elements for making the ferry or floating bridge.

15 Claims, 5 Drawing Sheets

(56) References Cited

U.S. PATENT DOCUMENTS

| | | | | |
|---|---|---|---|---|
| 5,353,733 | A | 10/1994 | Evans | |
| 6,234,103 | B1 * | 5/2001 | Emrich | 114/266 |
| 7,267,074 | B1 | 9/2007 | Hicks | |
| 8,382,539 | B2 * | 2/2013 | Richeux et al. | 440/12.5 |
| 2003/0143900 | A1 * | 7/2003 | Eberl | 440/12.5 |
| 2008/0280513 | A1 * | 11/2008 | Richeux et al. | 440/12.5 |
| 2010/0112876 | A1 * | 5/2010 | Richeux et al. | 440/12.5 |

* cited by examiner

MODULE FOR MAKING AMBIDROMIC CROSSOVER EQUIPMENT (FAM)

TECHNICAL FIELD

The present invention relates to a module for making ambidromic crossover equipment (FAM) and more particularly of modular ferry type for crossing waterways, the modules are also possibly able to be coupled in order to form a bridge.

The present invention also relates to a dedicated loading interface for said module.

BACKGROUND

The ferries and floating bridges are mainly intended to allow military vehicles to cross a stream or a river out of any bridge or other permanently set up ferry system. The applications may also be civil, after floods or inundations for example or for crossing a river without a permanent structure and in particular to allow the passage of heavy building site or crash rescue vehicles for example.

The most particularly targeted vehicles are endless track or wheeled vehicles of average mass able to weigh up to 30 to 60 tons.

The modules constituting the ad hoc ferry or bridge may in particular be brought to the required crossing point and assembled.

Generally, a ferry or floating bridge is made from one or several floatation tank(s), possibly motorized, and designed to support a track for the circulation of the vehicles on the ferry or the bridge.

In a complementary manner, said bridge or ferry may be terminated at one or both of its ends by an access ramp, usually foldable, or angularly adjustable, allowing the loading and unloading of the transported vehicles. Advantageously however, the ferry or bridge will be ambidromic.

In the case of a floating bridge assembly, the number of assembled modules will depend on the distance to cross and the floatation features of the floatation tanks. In the case of a transport ferry assembly, the number of assembled modules will obviously depend on the vehicles to be transported as well as their load based on the floatation features of the tanks.

An autonomous module containing the set of elements required for assembling the ferry or the floating bridge to be made does not exist, except for the amphibious and motorized autonomous vehicles such as the Forward Crossing Apparatuses (FCA). Such machines are not easily movable away from their point of attachment, in particular, by air and remain relatively expensive since they have their own amphibious motor system also requiring more important maintenance.

As regards transportable systems, there are ferries and floating bridges made from boats on which treadways, elements constituting the final haulage road, are set up transversally to the boats.

The assembling of a ferry or floating bridge hence currently requires the transport of said boats, treadways, motors to be set up on the boats, etc. . . . namely numerous scattered components usually rendering difficult a rapid rooting on site.

Moreover, the different elements being separate, the assembling requires a relatively long time and remains complex, the weight of each element having to be carried by a man should not exceed the military limits.

BRIEF SUMMARY

The present invention aims to propose a module allowing to make a modular ferry or floating bridge gathering the maximum, and preferably the totality, of the constituting elements and thereby simplifying the assembling operations.

Such a module must obviously remain easily routable on site and must meet international military standards and meet in particular the constraints of mass and dimensions of road, air and railway standards.

In order to do this, the present invention relates to a module for making a modular ferry and/or a floating bridge comprising a floatation tank, characterized in that said floatation tank is made in the form of two floatation half-tanks hinged together around a hinge line between an opening position in which the two half-tanks are substantially aligned and form the floatation tank, and a closing position in which a half-tank is folded back upon the other half-tank such as a lid thus forming a container box enclosing all or part of the elements making the ferry or floating bridge.

Thus, by providing a floatation tank in two half-tanks hinged on each other, said floatation tank is transformed into a box for the stowing of at least a part, and preferably the totality, of the various elements constituting the ferry or mobile bridge.

Generally, for making a ferry, it will hence be sufficient to transport two floatation tanks/boxes according to the invention, these boxes containing essential and required elements for making the ferry which may hence be started immediately.

It results in a significant logistics gain thanks to the ease of transport and the rapidity of the setting up.

Advantageously, the half-tanks are equipped with at least one mechanical means for assisting the opening and closing, in particular of cylinder type.

Still advantageously, at least one of the two half-tanks comprises at least one propulsion and aquatic steering means, in particular of water jet propeller type, preferably directional. It may in particular, be provided a main propeller, in particular, directional, and additional steering secondary propellers. Thus, it will not be necessary to provide the setting up of external propellers added onto the floating tank, the tank/box according to the invention able to enclose its own motorizing and propulsion means.

Will be aimed in particular propulsion means of which the thrust is provided to give the ferry or bridge speed capacities on water of at least 4 m/s.

According to an advantageous alternative embodiment, it may be provided two main directional propellers respectively located at the front and at the rear of a half-tank. This embodiment allows an improved maneuverability and does not require setting up additional steering secondary propellers.

The motor may also power one or several hydraulic, and/or electric, and/or pneumatic generator(s), to power various systems, in particular, for example cylinder type systems. In the case where two motors are set up, this would further allow redundancy of the functions thereof, in particular of pneumatic, hydraulic, and/or electric generator.

In a preferable manner, at least one half-tank comprises at least one stem float, preferably inflatable.

Such a stem float will in particular allow the module to have a drag compatible with the thrust of the propellers in order to obtain the required speed capacities on water.

Advantageously, at least one, and preferably each, of the half-tanks encloses at least one treadway element movably mounted between a stowing position in a low part of the half-tank and along a direction that is substantially longitudinal of said half-tank, and a deployed position in which the treadway element comes substantially over the half-tank and is directed substantially along a direction transversal to the half-tank in the vicinity of a median line of the floatation tank.

Still advantageously, the treadway element is mounted on a lifting means of cylinder type able to raise said treadway element from its stowing position in the lower part of the half-tank to at least a height corresponding to its deployed position.

In an advantageously complementary manner, the treadway element is pivotally mounted by at least 90 degrees, between a direction longitudinal to the half-tank and a direction transversal to said half-tank.

In a yet still complementary manner, the treadway element mounted translatable along a direction substantially longitudinal to the half-tank in such a manner as to be able to bring it from its stowing position, to its deployment position in the vicinity of the median line of the floatation tank.

Preferably, each half-tank encloses a half-treadway. This allows in particular to balance out the loads during the launching of the deployed floatation tank.

Advantageously, the module, in closing position is able to also enclose one or several ramp element(s) constituting at least one access ramp intended to be set up at one end of a treadway formed by the treadway elements thereof.

Preferably, at least one and advantageously the two treadway ends constituted of its treadway elements are equipped with connecting means to an end of a treadway also constituted of its treadway elements of a second module in deployed position. It may in particular comprise clevises able to cooperate in a form-fitting manner and able to receive a maintain axis.

In an advantageously complementary manner, at least one half-tank comprises at least one element of a unfoldable mast forming a derrick, said tank being able to contain the derrick in folded position.

This derrick may also serve where appropriate for the handling and lifting of the treadway elements, in particular to their pivoting and/or their translation.

This derrick further allows modifying the place of the ramps and possibly of the treadways according to the configurations of transport or of ferry or bridge work. In transport configuration, the derrick is folded.

The unfoldable mast may comprise in particular several sectors hinged onto one another and configured in such a manner that the straightening of a lower sector, in particular using a cylinder or other motorized means, forming mast foot, causes the deployment of the other hinged sectors.

Alternatively, it could for example comprise a telescopic mast or even a mast foot able to receive said mast in a dismountable manner. Such a deployable mast will allow operators to carry out the handling of the various elements, and in particular the ramp elements.

Preferably, at least one end of the treadway is equipped with at least one directional motorized part, in particular, by at least one cylinder, and in particular able to direct the access ramp where appropriate. Furthermore, when an end will not be equipped with an access ramp, these directional parts will allow ensuring the evenness and the good leveling of the treadways between two modules forming the ferry.

In an advantageously complementary manner, the treadway is equipped with at least one centering and indexing means, preferably deployable, in particular using one or several cylinder(s), able to cooperate with a corresponding centering and indexing means of a treadway of a second module. The centering and indexing means could be exhibited in the form of indexing arms located under the treadway exhibiting an end substantially triangular or conical, and able to penetrate in a corresponding housing of a treadway of a second deployed module.

Advantageously, the module is equipped with at least one gripping means by a hookloader, in particular of U-bolt type.

The present invention further relates to a support interface for transporting a module according to the invention, comprising a transport tray intended to receive said module and equipped with at least one gripping means by a hookloader characterized in that said transport tray is equipped with at least one cart movably mounted in translation along the transport tray between a retrieval position in which the cart is located in the vicinity of an end of the tray in such a manner as to allow the hooking and retrieval of the module to be transported and a transport position in which the cart is pulled up towards the gripping means by the hookloader with a view to pulling the module onto the tray.

This interface is intended to largely facilitate the transport, launching and retrieval of the modules according to the invention with sheer-edged banks as well as with sloping banks.

This interface, and more particularly the hookloader, also allows the earthing of the module, its placing on a wagon, for example, or on an access ramp of a cargo aircraft.

BRIEF DESCRIPTION OF THE DRAWINGS

The present invention will be better understood in light of the following detailed description with respect to the accompanying drawing in which.

DETAILED DESCRIPTION

Figure 1:
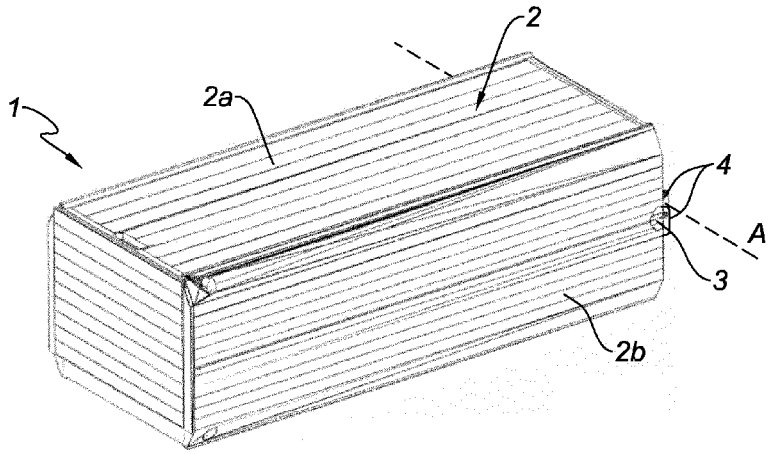
FIG. 1 is a perspective schematic representation of a module according to the invention in closing position.
Figure 2:
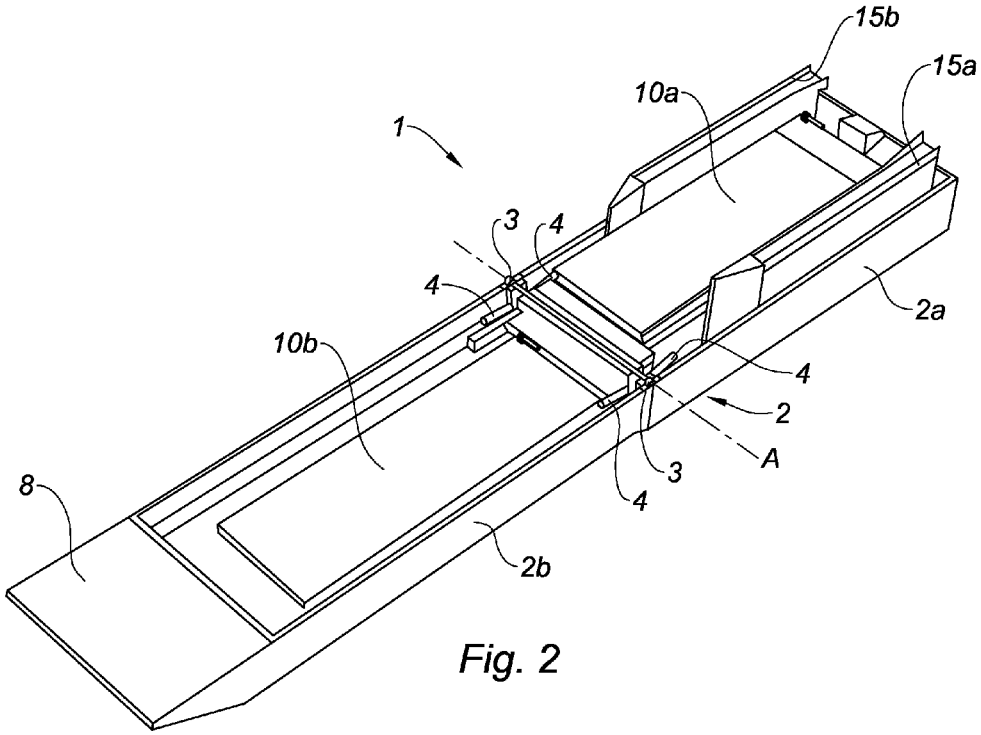
FIG. 2 is a perspective schematic representation of the module of FIG. 1 in opening position of the floatation tank.
Figure 3:
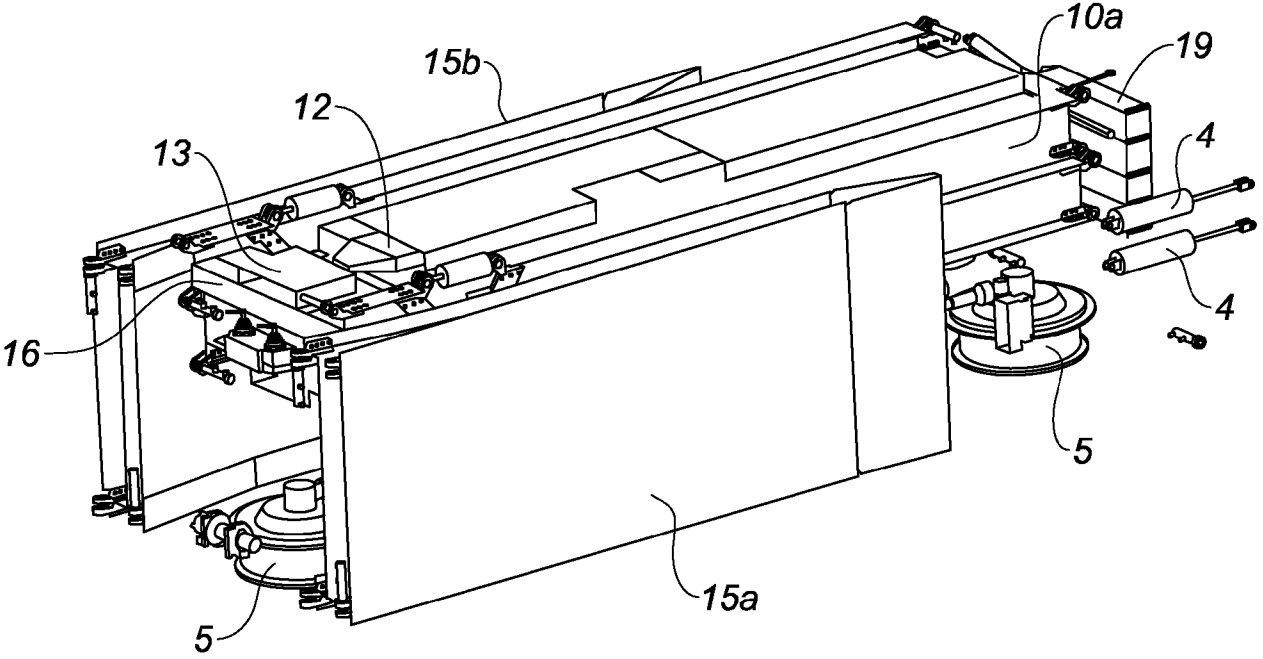
FIG. 3 is a perspective schematic representation of the inside of the tank.

FIGS. 1 and 2 show a module 1 according to the invention for making a modular ferry for crossing waterways, the modules 1 able to possibly also be coupled to form a bridge.

In accordance with the invention, this module 1 comprises a floatation tank 2 made in the form of two floatation half-tanks 2*a*, 2*b*.

The two floatation half-tanks 2*a*, 2*b* are hinged together around pivoting pieces 3 along a hinge line A between an opening position (FIG. 2) in which the two half-tanks 2*a*, 2*b* are substantially aligned and form the floatation tank 2, and a closing position in which a half-tank is folded back upon the other half-tank such as a lid thus forming a container box able to enclose elements for making the ferry or floating bridge.

FIG. 1 shows the module 1 in closing position, that is to say forming a box intended to contain elements constituting the ferry, a floatation half-tank 2*b* forming a lid for the box.

FIG. 2 shows the module 1 in opening position, in which the floatation half-tank 2*b* forming the lid of the box has been pivoted around the hinge line A in such a manner as to come in the alignment of the first floatation half-tank 2*a*, thus forming the complete floatation tank 2.

In a manner as to allow operators to open the module 1, the half-tanks 2*a*, 2*b* are equipped with at least one mechanical means for assisting the opening and closing, in particular of cylinder type. In this instance, these mechanical means are exhibited in the form of lateral cylinders 4, exhibiting a first end connected to one of the half-tanks 2*a*, 2*b* and a second end connected to a pivoting piece 3 in such a manner as to allow operators to open the module 1.

These cylinders 4 may be powered by an external booster, for example, or possibly directly by a generator inside the module 1 and which can be started up from the outside.

In the case of an inner generator, the latter may be powered by a motor inside the module, which can be started up from the outside, and provided in particular to drive propulsion means and other generators if need be (electric, hydraulic and pneumatic generators).

To this end, the module 1 comprises two motor units 5 each powering an associated propulsion means of water jet propeller type and disposed in a bottom of the first floatation tank 2*a*, the latter being provided with openings accordingly.

In this instance, the half-tank 2*b* hence forms a bow tank while the half-tank 2*a* forms a stern tank.

These propulsion means are directional and allow a large maneuverability of the floatation tank 2. The motor unit associated with a propulsion means forms a motor-propulsion group.

More particularly and preferably, the propellers will hence be directional water jet propellers and of which the outlet of propelled water is slanted by around 15 degrees below the hull of the floatation half-tank 2*a*. Thus, such a propeller allows navigating with a low water height under the hull (up to a few centimeters).

Furthermore, as aforementioned, the motor units 5 may each comprise a hydraulic and/or electric and/or pneumatic generator function.

The presence of two motor units 5 allows a safety redundancy of these functionalities and of the propulsion.

Alternatively, other propulsion systems may be implemented.

Thus, it may be provided one single motor unit powering a main propulsion means of water jet propeller type and disposed at the bottom of the first floatation tank 2*a*, and which will also allow the powering of steering start motors, in particular of stem propellers located in the vicinity of a front end of the second half-tank 2*b* and/or at the rear of the half-tank 2*a*.

Advantageously, the main propulsion means will be equally directional. It may also be provided two secondary propellers, positioned one at the front (half-tank 2*b*) and the other at the rear (half-tank 2*a*), each propeller comprising a helix disposed in a substantially horizontal tube opening under the floatation line.

The secondary propellers may be used to correct the trajectory of the floatation tank 2, in particular during coupling maneuvers between modules 1 to constitute a ferry or floating bridges and during navigation maneuvers of the constituted ferry.

The propulsion means are completed by a piloting post 7, possibly dismountable and stowable in a half-tank 2*a* or able to be taken away by the pilot. The motor-propeller unit 5 will also preferably be able to power one or several equipments for generating hydraulic, electric or pneumatic power.

In a manner such as to improve navigation performances, the half-tank 2*b* forming bow will be equipped with a stem float 8, inflatable, and protected by a metal plate in order to make berthings on the bank edges. This plate 8 is foldable against the half-tank 2*b* when the float is deflated and that the module 1 is in closing position.

In accordance with the invention, the module 1 accommodates, in closing position all or part of the elements constituting the ferry to be made.

More particularly, each half-tank 2*a*, 2*b* encloses a treadway element 10*a*, 10*b* movably mounted between a stowing position in a low part of the half-tank 2*a*, 2*b* and along a substantially longitudinal direction of said half-tank, and a deployed position in which the treadway element 10*a*, 10*b* comes substantially over the half-tank 2*a*, 2*b* and is directed substantially along a direction transversal to the half-tank in the vicinity of a median line of the floatation tank.

FIG. 2 shows the treadway 10 elements 10*a*, 10*b* in stowing position in their respective half-tank 2*a*, 2*b*. The treadway element 10*a* resting on the motor-propeller units 5, it is raised with respect to the element 10*b* of the other half-tank 2*b*.

Each half-tank 2*a*, 2*b* comprises a treadway element 10*a*, 10*b* each forming more particularly a half-treadway.

Thus, a treadway 10 intended to form a 4 m wide path for the passage of the vehicles will be achieved based on two half-treadways 10*a*, 10*b* of around two meters wide each, and more particularly around 1.8 m each in order to take various interstitial spaces into account. The length of each treadway 10 element 10*a*, 10*b* is slightly lower than the length of each half-tank 2*a*, 2*b*.

In order to facilitate the passage of the treadway elements 10*a*, 10*b* from their (longitudinal) stowing position to their (transversal) deployed position, each treadway 10 element 10*a*, 10*b* is mounted on a cylinder, not visible, substantially central, allowing to lift said treadway 10 element 10*a*, 10*b* from its low position inside the floatation tank 2 to a high position slightly over the floatation tank 2 in such a manner as to allow its rotation to a substantially transversal direction.

In order to do this, the treadway 10 element 10*a*, 10*b* is hence also pivotally mounted on the raising cylinder thereof, or the raising cylinder is itself able to pivot.

Advantageously, the treadway 10 element 10*a*, 10*b* may be pivoted indifferently in one rotation direction or the other. In fact, according to the configuration of the coupling means exhibited by the other module 1, it may prove necessary to place the treadway 10 in one direction or the other.

The placing of the treadway 10 element 10*a*, 10*b* is completed by a translation along a substantially longitudinal direction of the half-tank 2*a*, 2*b* to a substantially median area of the floatation tank 2 (to near load balance).

Thus, the two treadway elements 10*a*, 10*b* join together anew in the vicinity of a median line to form the treadway 10 exhibiting the required total width equal to twice the width of a half-treadway 10*a*, 10*b*, and thus constituting a track for the vehicles to be transported.

Once the treadway elements 10*a*, 10*b*, are in place, the constituting of a ferry 100 may begin.

Figure 4:
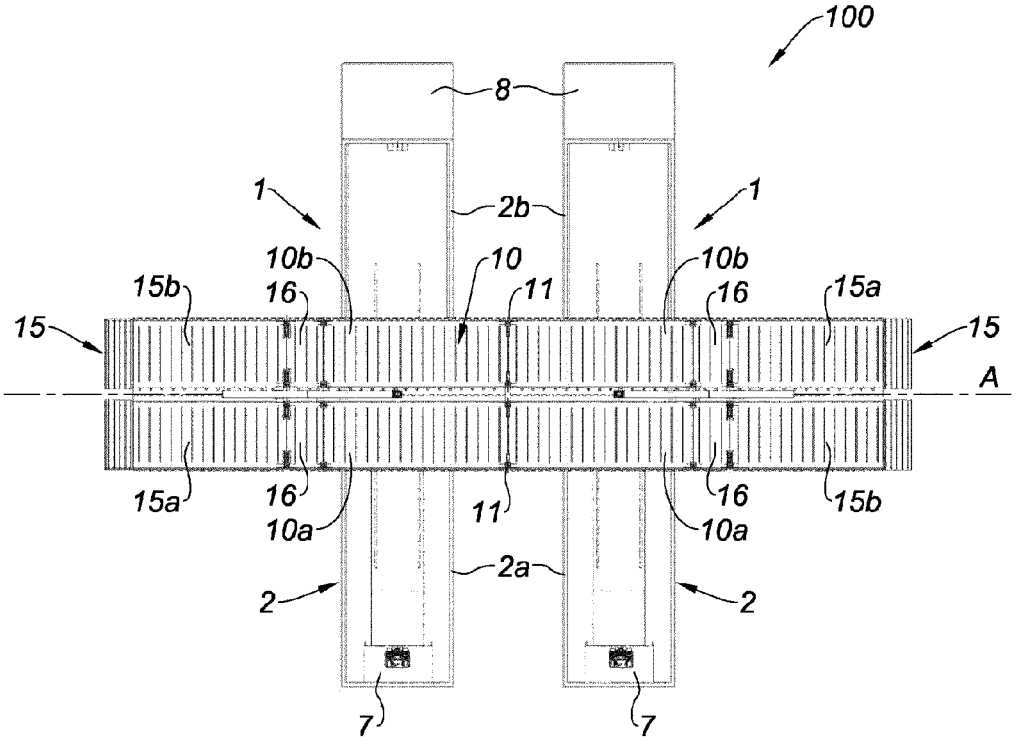
FIG. 4 is a schematic top view of two modules according to the invention assembled to form a ferry.
Figure 5:
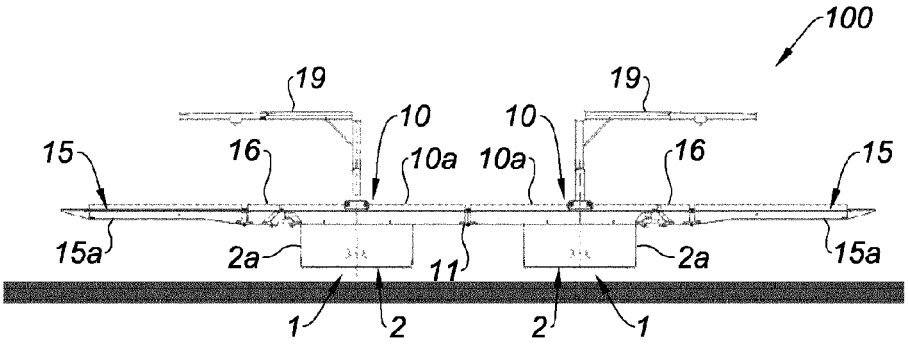
FIG. 5 is a schematic side view of the ferry of FIG. 4, FIGS. 6 and 7 respectively represent a step of launching and a step of retrieving the module of FIG. 1.

A ferry 100, such as represented on FIGS. 4 and 5 is made based on two modules 1 by coupling the treadways 10 of each module 1.

In order to do this, each end of a treadway 10 of the first module 1 is equipped with means for connecting an end of a treadway 10 of the second module 1 in deployed position. It may in particular comprise a system of clevises 11 able to cooperate in a form fitting manner and secured by inserting axes (non visible).

Advantageously, the axes may be mounted at an end of a treadway and actuated mechanically, for example using a cylinder.

Furthermore, in order to facilitate the coupling of modules 1, the treadway 10 will be advantageously equipped with centering and indexing means deployable, exhibited in particular in the form of indexing arms 12 deployed using cylinders and able to penetrate in a corresponding housing 13 of the treadway 10 of the second module 2.

Thus, it is worth noting that the indexing arm 12 is disposed in the continuity of the through housing 13. Thus, one single central centering and indexing element may be provided able according to requirements to serve as a male (arm 12 coming out through the housing 13) or female element (retracted arm 12 and free housing 13 for receiving an arm 12 of the treadway element 10*a* to be coupled.

It is noted that an end of each half-treadway 10*a*, 10*b* is equipped with at least one directional part 16, on an inner face of which is disposed the housing 13, associated with an actuator, in particular at least a cylinder, and in particular able to direct an access ramp 15 if need be and block it in position during the passage of the vehicles. In the case of a bridge, the non used parts 16 for setting up a ramp 15 will be maintained substantially horizontal and will ensure the leveling of the track.

As aforementioned, each module 1, in closing position is able to also enclose one or several elements constituting at least one access ramp 15 intended to be set up at an end of the treadway 10.

As for the treadway 10, the ramp 15 is exhibited in the form of two half-ramps 15*a*, 15*b* stored separately in the module 1 and assembled to form the ramp.

To do this, each half-ramp 15*a*, 15*b* is mounted on an end of an associated half-treadway 10*a*, 10*b*, and more particularly, is fastened to a part 16 which will allow its direction.

The two half-ramps 15*a*, 15*b* will then be possibly secured together, using rapid fixing or bolting means, in order to ensure the unity of the ramp 15.

In accordance with an advantageous aspect of the invention, the half-ramps 15*a*, 15*b* will be set up using at least one derrick 19, equipped in particular with a hydraulic or electric winch.

According to an advantageous embodiment, the derrick is made based on a unfoldable mast comprising several sectors hinged on top of each other and configured in such a manner that the straightening of a lower sector, in particular using a cylinder or another motorized means, forming mast foot causes the deployment of the other hinged sectors.

Alternatively, according to another embodiment given by way of example, the derrick may be set up on a telescopic mast fixed in the tank 2 substantially at the median line of the two half-treadways 10*a*, 10*b*. The telescopic mast may be replaced with a mast foot able to receive a dismountable mast, which may be stowed in the floatation tank 2.

More particularly, the derrick 19 is arranged in such a manner as to be able to be deployed between the half-treadways 10*a*, 10*b* in deployed position transversally to the floatation tank 2. A slight corresponding cut out may be provided on the edges of the half-treadways 10*a*, 10*b* in such a manner as to allow the passage if necessary of said derrick 19 if need be.

The derrick 19 allows handling elements contained in the module 1 and in particular the half-ramps 15*a*, 15*b* which are set up on their flank, before moving into functional position once the half-ramp 15*a*, 15*b* at least partially fastened to the part 16.

A complete access ramps 15, is hence fixed by means of upper clevises of the half-treadways 10*a*, 10*b* and more particularly parts 16, directly in functional position and connection to lower devises of said parts 16.

Advantageously, the ferry 100 made will be ambidromic, the first module 1 being equipped with a ramp for the ascent of the vehicle or vehicles to be transported, the second module being equipped with a similar ramp for the descent of said vehicles.

In a complementary manner, wheel guides may be stored along the treadways 10 and placed manually. It may also be provided wheel guides specific to the ramps 15, also placed manually. These wheel guides are constituted, for example, of simple cornices held to the profile of the bank by the fusible studs.

A duckboard forming a small central planking may be placed to cover the gap between the two half-ramps 15*a*, 15*b*.

Likewise, for the treadways 10, when the derrick 19 is located at the treadway 10, and despite the maximum bringing closer together of the treadway elements 10 *a*, 10*b*, it may subsist a gap between the treadway elements 10*a*, 10*b*.

This gap may be advantageously filled by the placing, in particular manual, of a duckboard also forming central planking between the two treadway elements 10*a*, 10*b*. It may also be provided lateral wheel guides, which can be folded back, equipping the treadway elements 10*a*, 10*b*. The outer wheel guides will be lifted to delimit the edge of the track whereas the inner wheel guides will be simply placed horizontally to cover the gap between the two treadway elements 10*a*, 10*b*.

A piece forming sleeper may be provided to tightly connect the two half-cusps of the end of ramps 15 and ensure a good stiffness of the ramp 15 during embarkation of the vehicles.

After folding the derrick 19, the ferry 100 thus formed using two modules 1 according to the invention is operational.

The length of loading without ramps will be calculated in such a manner as to be compatible with the length of the wheeled vehicles of the related classes. The ramps 15 may in part, be loaded on the ferry in navigation with light vehicles. The features of the floatation tank 2 will be obviously determined to meet the required floatation conditions.

A floating bridge will be constituted in the same manner, and composed of a necessary number of modules 2 deployed according to the required length.

It will also be noted that apart from a ferry 100 or floating bridge usage, the modules 1 simply opened but not entirely deployed (FIG. 2) may serve as transport barge (in particular for staff and sand bags for example, or other bundling).

In a complementary manner, each floatation tank 2 may be equipped with an anchor, preferably setup in a well opening through a wall of the half-tank 2*b* and hung by a chain. The dispatching is done by gravity and the ascent of the set may be ensured by a hydraulic or electric guide bank with manual emergency control, the chain may be stored in a chest.

Figure 6:
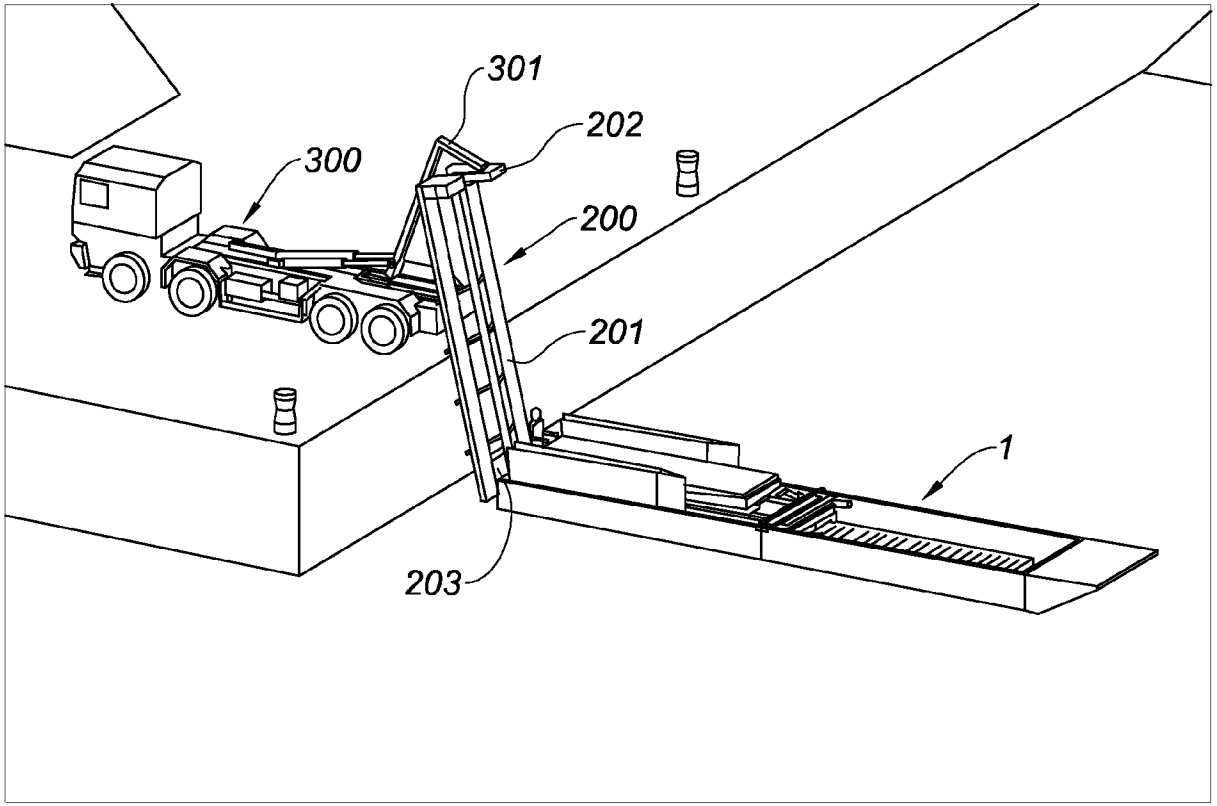

The present invention also relates to a support interface 200 for a module 1 according to the invention. An embodiment example and usage of such a support interface 200 is represented on FIGS. 6 and 7.

A module 1 is intended to be transported, in particular but not exclusively, on site by means of military transport lorries 300 equipped with a hookloader 301 (known by the name of Porteur Polyvalent Terrestre or PPT).

To do this, the support interface 200, comprises a transport tray 201 intended to receive said module 1 and equipped with at least gripping means 202 by the hookloader 301.

The transport tray 201 is equipped with a cart 203 movably mounted in translation along the transport tray 201 between a retrieval position (FIG. 6) in which the cart 203 is located in the vicinity of an end of the tray 201 in such a manner as to allow the hanging and retrieval of the module 1 to be transported and a transport position in which the cart 203 is lifted towards the gripping means 202 by the hookloader 301 with a view to pulling the module on the tray.

Figure 7:
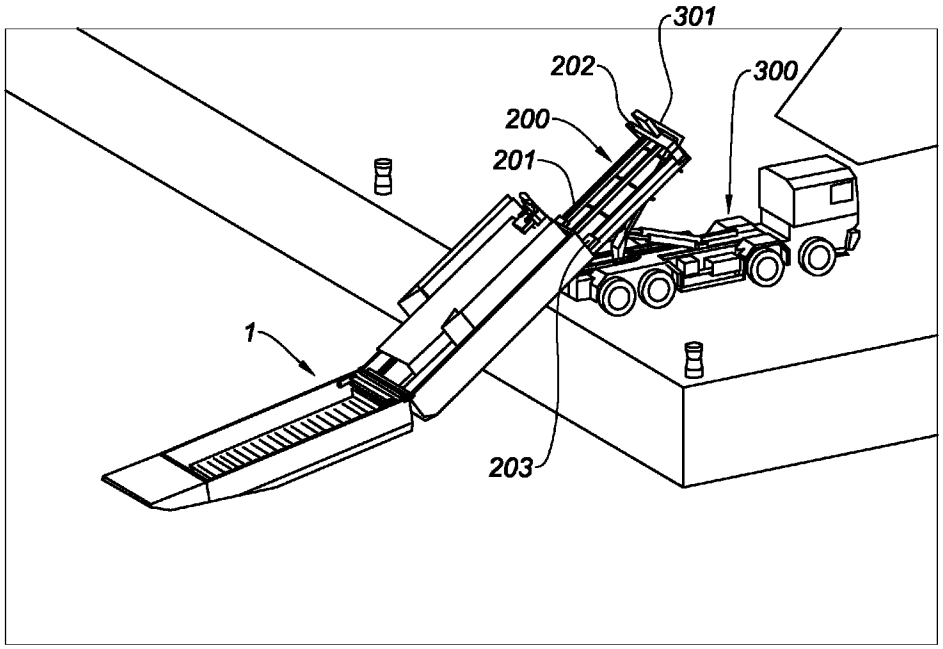

FIG. 7 illustrates the operating of the support interface 200 in intermediate position for retrieving a module 1 from the water according to the invention at a sheer edge embankment.

As aforementioned, the proposed support interface 200 allows to do without the type of bank and allows in particular a loading and unloading of the module 1 even on sheer edge banks.

Alternatively, in the case of less high sheer edge embankments, it is possible to go without the support interface and carry out a launching and retrieval using a telescopic hookloader.

Obviously, the hookloader is also usable directly or through its support interface to load or disembark a module 1 in the absence of a sheer edge, on a soft sloping bank, in particular a beach. In such a case, it may be considered a direct launching and retrieval of the module by bringing the rear of the lorry to the level of the water.

According to additional advantageous features, the module 1 will be designed in such a manner as to be unsinkable when empty. It may also be rendered hardly sensitive to the firing of light weapons by providing a multi compartmenting of the walls and bottom as well as a compartmenting of the stem float. Moreover, the module may be equipped with powerful bilge pumps.

Modules 1 may also be used for implementing a culvert. To do this, a first module 1 simply open but not deployed will be used, and a second module 1 open and of which the treadway 10 would have been deployed as explained beforehand.

The two modules 10 will be placed on the ground, disposed beside each other, as nearest as possible and substantially parallel.

The treadway 10 of the second module is deployed and hence extends across the set. The ramp elements stored in the first module 1 and the ramp elements of the second module 1 are put in place at the ends of a treadway.

The means for fixing the treadway 10 to the telescopic cylinder of its module 1 are dismantled.

Thus the culvert is constituted of a treadway 10 forming track and of its end ramps and is unsecured from the floatation tanks 2.

Thus assembled, the culvert may be carried at the pit to be crossed by the transport lorry 300 as mentioned beforehand.

According to the mass to be taken over the culvert, it will be possible to adapt the set by only using the ramps and no longer the treadway 10 so as to form a slightly shorter culvert but exhibiting an increased bending resistance.

The ramps on either side of the treadway 10 will allow the bearing of the culvert on the edges of the pit and the passage of the vehicles.

Although the invention has been described with a particular embodiment example, it is obvious that it is in no way limited thereto and that it comprises all technical equivalents of the described means as well as their combinations should these fall within the scope of the invention.

The invention claimed is:

1. A module for making a floating bridge, comprising:

a floatation tank comprising two floatation half-tanks hinged together around a hinged line to assume:

an open position, in which the two floatation half-tanks are substantially aligned in a floating bridge configuration, and a closed position, in which the two floatation half-tanks are folded back upon each other in a container box configuration; and floating bridge elements enclosable within the floatation tank with the two floatation half-tanks assuming the closed position, the floating bridge elements comprising at least one treadway element movably mounted between:

a stowed position in a lower part of one of the two floatation half-tanks with the at least one treadway element extending along a substantially longitudinal axis of the one of the two floatation half-tanks, and a deployed position in which the at least one treadway element is disposed substantially over the one of the two floatation half-tanks and extends transversely with respect to the longitudinal axis proximate to a median line of the one of the two floatation half-tanks.

2. The module according to claim 1, wherein the two floatation half-tanks comprise mechanical means for assisting an opening and closing of the floatation tank.

3. The module according to claim 1, wherein at least one of the two floatation half-tanks comprises at least one propulsion and aquatic steering means.

4. The module according to claim 1, wherein at least one of the two floatation half-tanks comprises at least one stem float.

5. The module according to claim 1, wherein the at least one treadway element is mounted on a lifting means configured to raise the at least one treadway element from the stowed position to the deployed position.

6. The module according to claim 1, wherein the at least one treadway element is mounted to pivot by at least 90 degrees.

7. The module according to claim 1, wherein the at least one treadway element is mounted to be translatable along the longitudinal axis.

8. The module according to claim 1, wherein each of the two floatation half-tanks encloses a half-treadway.

9. The module according to claim 1, wherein the floatation tank encloses at least one treadway end access ramp in the closed position.

10. The module according to claim 1, wherein an end of the at least one treadway element comprises means for connecting to a second module in the deployed position.

11. The module according to claim 1, wherein the end of the at least one treadway element comprises an access ramp directing motorized part.

12. The module according to claim 1, wherein at least one of the two floatation half-tanks comprises at least one unfoldable mast forming derrick.

13. The module according to claim 1, wherein the at least one treadway element comprises centering and indexing means configured, to cooperate with a corresponding centering and indexing means of a second module treadway.

14. The module according to claim 1, further comprising hookloader gripping means.

15. A floating bridge module, comprising:

half-tanks hinged together to assume an open position, in which the half-tanks are aligned in a floating bridge configuration, and a closed position, in which the half-tanks are folded into a container configuration; and floating bridge elements enclosable within the half-tanks with the half-tanks assuming the closed position, the floating bridge elements comprising a treadway element movably mounted between:

a stowed position in a lower part of one of the half-tanks with the treadway element extending along a longitudinal axis of the one of the half-tanks, and a deployed position in which the treadway element is disposed over the one of the half-tanks and extends transversely with respect to the longitudinal axis proximate to a median line of the one of the half-tanks.

* * * * *